US010174956B2

(12) United States Patent
Stanton

(10) Patent No.: US 10,174,956 B2
(45) Date of Patent: Jan. 8, 2019

(54) ANTI-THEFT AIR CONDITIONER ENCLOSURE

(71) Applicant: Robert J. Stanton, Weatherford, TX (US)

(72) Inventor: Robert J. Stanton, Weatherford, TX (US)

( * ) Notice: Subject to any disclaimer, the term of this patent is extended or adjusted under 35 U.S.C. 154(b) by 0 days.

(21) Appl. No.: 15/409,715

(22) Filed: Jan. 19, 2017

(65) Prior Publication Data

US 2018/0202670 A1 Jul. 19, 2018

(51) Int. Cl.

| | |
|---|---|
| ***F24F 1/48*** | (2011.01) |
| ***F24F 1/58*** | (2011.01) |
| ***B65D 6/02*** | (2006.01) |
| ***B65D 6/08*** | (2006.01) |
| ***B65D 6/00*** | (2006.01) |
| ***B65D 85/68*** | (2006.01) |
| ***E05B 67/38*** | (2006.01) |

(52) U.S. Cl.

CPC ..... *F24F 1/58* (2013.01); *B65D 7/06* (2013.01); *B65D 7/14* (2013.01); *B65D 7/42* (2013.01); *B65D 85/68* (2013.01); *E05B 67/383* (2013.01); *B65D 2585/6812* (2013.01); *F24F 2221/44* (2013.01)

(58) Field of Classification Search

CPC ... B65D 7/14; B65D 7/06; B65D 7/42; B65D 2585/6812; F24F 2221/44; F24F 1/58

See application file for complete search history.

(56) References Cited

U.S. PATENT DOCUMENTS

| | | | | |
|---|---|---|---|---|
| 6,138,993 | A * | 10/2000 | Mitchell, Jr. | E04H 17/163 256/25 |
| 6,158,175 | A * | 12/2000 | Carter | F24F 1/58 52/23 |
| 6,186,158 | B1 * | 2/2001 | Goarin | F24F 1/58 135/128 |
| 6,430,954 | B1 * | 8/2002 | Smith | F24F 1/58 135/913 |
| 6,851,771 | B2 * | 2/2005 | Marler | E04H 1/1238 119/452 |
| 7,836,653 | B1 * | 11/2010 | Herrington | F24F 1/58 256/25 |
| 8,505,182 | B2 * | 8/2013 | Kuhn | B65F 1/1426 29/428 |
| 8,510,998 | B1 * | 8/2013 | Martinez | F24F 1/58 52/3 |

(Continued)

*Primary Examiner* — Adriana Figueroa

(74) *Attorney, Agent, or Firm* — Whitaker Chalk Swindle & Schwartz PLLC; Charles Gunter

(57) ABSTRACT

An anti-theft enclosure for protecting an outdoor air conditioning (A/C) unit is made up of an open framework of structural members which surround and protect the A/C unit. Individual steel panels are assembled to form a series of upstanding walls which are covered by a top panels and which together define the quasi-enclosed area surrounding the A/C unit. The tubing which makes up the steel panels is spaced to allow access to the enclosed area by a worker needing to access the A/C unit. The steel panels are joined with connecting and mating elements which facilitate easy and quick disassembling of the enclosure. The upright panels also have adjustable panel legs which can be extended and cemented into the ground for added stability and security.

8 Claims, 4 Drawing Sheets

(56) References Cited

U.S. PATENT DOCUMENTS

| | | | | |
|---|---|---|---|---|
| 8,596,015 | B2 * | 12/2013 | Coon | E05B 73/00 248/354.1 |
| 8,677,790 | B2 * | 3/2014 | Ramsey | F24F 1/56 109/49.5 |
| 9,187,904 | B2 | 11/2015 | Stanton | |
| 9,752,372 | B2 * | 9/2017 | Arendsee | E05G 1/024 |
| 2008/0178624 | A1 * | 7/2008 | Zedney | F24F 1/58 62/259.1 |
| 2013/0161215 | A1 * | 6/2013 | Dowdy | F24F 1/58 206/320 |
| 2014/0232249 | A1 * | 8/2014 | White | F24F 1/58 312/215 |

* cited by examiner

ANTI-THEFT AIR CONDITIONER ENCLOSURE

BACKGROUND OF THE INVENTION

A. Field of the Invention

The present invention relates generally to a security apparatus and method for protecting outdoor air conditioning units from theft and vandalism and, more specifically, to a specially adapted enclosure for physically securing exposed air conditioner equipment, such as condensers, compressors, heat transfer coils, piping, and accessory equipment located externally to a building.

B. Description of the Prior Art

Heating, ventilating, air conditioning systems (HVAC) are widely used at the present time to regulate the temperature in a given structure, for example, in residential homes or commercial buildings, by either cooling or heating air to a desired temperature and then circulating the conditioned air into the building. Most HVAC systems utilize a split air conditioner system referred to herein as the A/C system, where a portion of the A/C system is located inside of a building and a portion of the A/C system is located outside of the building. Typically, the inside portion of the A/C system is protected against theft and vandalism by controlling physical access to the inside portion's location, such as its location in a utility closet, in some cases with a door having a lock and key. However, the same cannot be said for the outside portion for an A/C system. This external A/C unit is typically located on a cement slab next to the building structure with no physical access control being provided.

These external A/C units can vary in price up to a few thousand dollars to tens of thousands of dollars in the case of commercial units. Theft of such units therefore represents a significant financial loss, not to mention the cost of personal discomfort attributed to the subsequent lack of temperature control, the severity of which will depend upon the weather at the time. Just as valuable, are the external A/C unit's internal components. Theft of such internal components is a relatively easy prospect, given the lack of security of the A/C unit. The damage caused to a scavenged unit can be catastrophic. Additionally, it is becoming more and more common at the present time for thieves to steal the entire external A/C unit, removing it from its placement on its associated concrete pad. There are also other ways than theft or vandalism in which the A/C unit can be damaged, such that protection is warranted. For example, one way in which damage can occur is due to the nature of the proximity of maintenance machines, such as lawn mowers, that may come within inches of the A/C unit and can expel harmful objects toward the A/C unit.

Various schemes have been proposed for protecting A/C units. However, the prior art proposals have generally been lacking in one or more respects. For example, certain of the prior art constructions were permanent in nature and were not easily removed or shipped. Other proposed solutions were overly complex and expensive to produce.

In addition to providing basic anti-theft protection, a further feature of a suitable anti-theft enclosure for purposes of the present invention is that it must accommodate service tools and instruments which may periodically inserted into the A/C unit for various reasons. It is also obviously necessary for service personnel to be able to access the A/C unit's internal components to perform these and other customary service operations. Many times, simply providing a hinged door or other fixed access is not sufficient access to the A/C unit. It may be necessary to access the A/C unit unimpeded from multiple sides, without having to maneuver around fixed enclosure components.

A need exists, therefore, to provide an improved anti-theft and anti-vandalism enclosure for an A/C unit of the type under consideration. Preferably, the protective enclosure would be designed to deflect or deter damaging contact away from an A/C unit in addition to providing the primary anti-theft function. In addition to functioning as an anti-theft enclosure, another primary feature anti-theft enclosure would be to permit the A/C unit to operate in a safe manner and yet be readily accessible for workover purposes and/or for inspection, routine maintenance, or other such purposes. The enclosure would also preferably be assembled from a number of component parts which could be disassembled for ease of shipment and transported to another location, when desired, with a minimum of effort being required for the disassembly.

Thus, there continues to exist a need for an improved anti-theft enclosure for an air conditioner unit, which would meet the previously expressed deficiencies of the known art.

SUMMARY OF THE INVENTION

In order to address the foregoing needs, there is provided an anti-theft/anti-vandalism air conditioning enclosure which is sufficiently sturdy to perform its designed function, and yet can be readily transported and installed. The enclosure is initially fabricated into discrete parts or sections which can be stacked linearly to decrease the overall package size, thereby allowing the enclosure to be easily shipped and stored. Advantageously, the enclosure can be broken down into its respective component parts and set aside to allow complete accessibility to an outdoor A/C unit if the situation warrants.

The preferred anti-theft enclosure is comprised of an open framework of structural members which define a quasi-enclosed area adapted to surround and protect the A/C unit. The open framework of structural members includes a pair of opposing side panels, a front panel, a rear panel, and a top panel. The opposing side panels are spaced apart a selected distance and are positionable generally perpendicular to a surrounding support surface. The support surface could be the surrounding earth but, in most cases, will be a concrete support pad, or the like. The rear panel connects and supports the pair of opposing side panels. The rear panel includes connecting elements at either of two opposite extents thereof. The connecting elements are engageable with mating connecting elements provided on each of the opposing side panels for connecting the rear panel to the side panels.

The front panel includes oppositely arranged connecting elements, which are also engageable with the mating elements on each of the opposing side panels for connecting the front panel to the side panels. The front, rear, and side panels define an initially-open top region, or open perimeter, of the enclosure. Advantageously, the pair of opposing side panels include at least one retention flange located at least partially along the respective top rails of the opposing side panels. The retention flanges on each of the opposing side panels cooperate to define an at least partially enclosed track region, which runs along each of the respective top rails of the opposing side panels. The top panel, when oriented horizontally, is receivable within the track regions of the opposing side panels in sliding fashion to thereby cover the initially open top region of the enclosure.

Preferably, each of the steel panels is constructed of lengths of steel tubing. Each panel can include a plurality of spaced apart security bars which run vertically between the top and bottom rails. The security bars can conveniently be constructed of lengths of polygonally shaped metal tubing. Alternatively, the panels can be covered with a steel grating or other covering material, depending upon the end application. For example, the top panel might be covered with a more dense covering material to provide a shaded enclosure for the A/C unit in the summer heat. The lengths of steel tubing which make up the steel panels can be spaced appropriately to allow access to the quasi-enclosed area by a worker needing to access the A/C unit.

In one preferred form of the invention, the opposing side panels are also provided with adjustable panel legs which can be varied in height, such that an overall height and orientation of the enclosure can be varied to suit varying surfaces.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
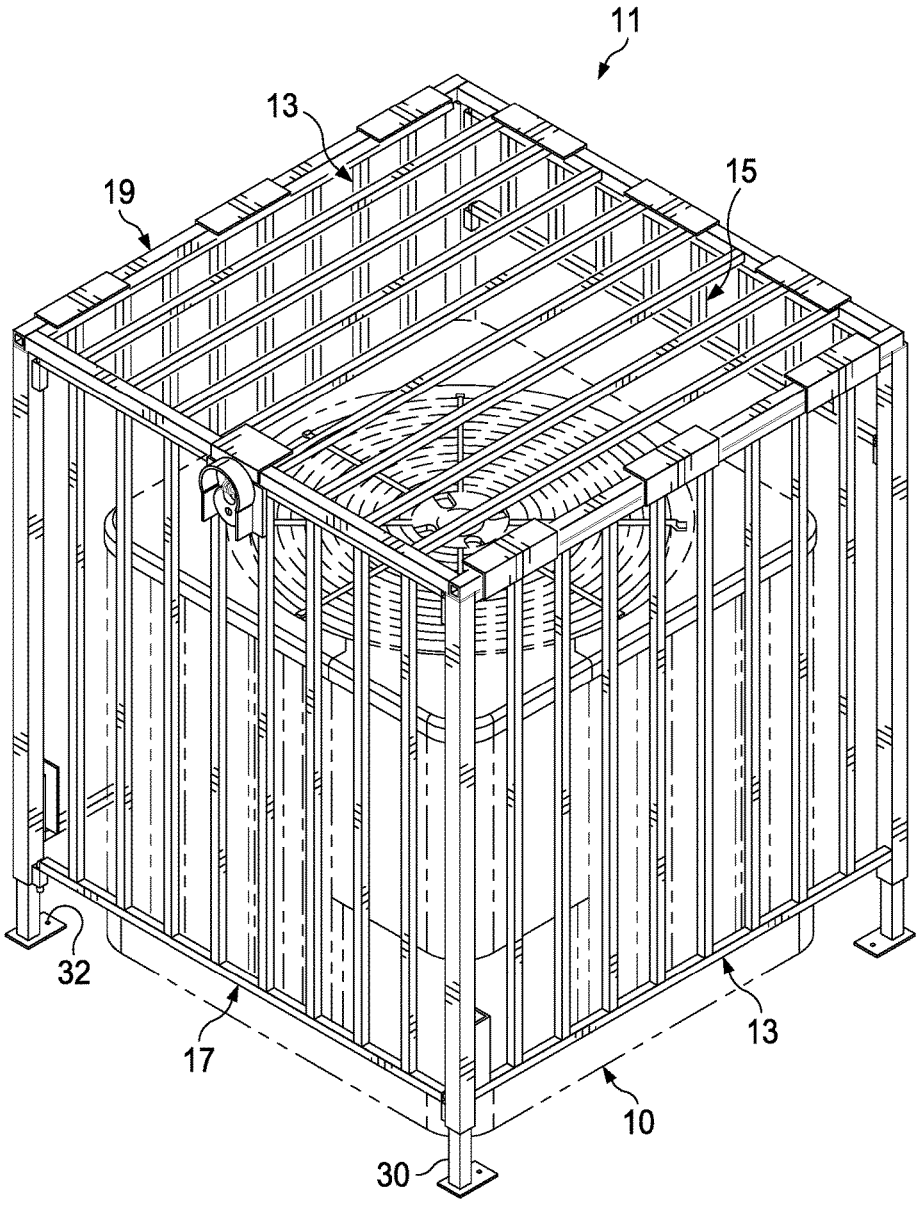
FIG. 1 is a perspective view of the anti-theft air conditioning enclosure, showing the assembled panels in place on an air conditioning unit.

FIG. 1 is a perspective view of the anti-theft enclosure of the invention, designated generally as 11. The enclosure H is used to enclose a number of different air conditioning (A/C) units, such as A/C unit 10. Such A/C units are well known in the relevant arts and will not be described in detail other than to say that they are typically a component part of an overall HVAC system which may include, for example, a condenser, a compressor, heat transfer coils, piping, and other conventional components, the overall HVAC system being used to control the temperature in a building. The A/C unit shown in FIG. 1 is the compressor/condenser component of the HVAC system, which component is typically mounted exteriorly of the building or structure to be heated or cooled. As will be appreciated from FIG. 1, the protective enclosure 11 encloses the A/C unit 10, at a location external to a building in order to help prevent theft/vandalism or otherwise protect the A/C unit 10 from objects which might be brought into damaging contact with it.

The anti-theft enclosure 11 is made up of an open framework of structural members which define a quasi-enclosed area adapted to surround and protect the A/C unit 23 placed on a surface, such as the ground or a concrete slab. Two or more side panels 13, a rear panel 15 and a front panel 17 are assembled to form a series of upstanding walls, generally perpendicular to the surface. The panels 13, 15, and 17 are covered by a top panel 19, and together define the quasi-enclosed area surrounding the A/C unit 10. The anti-theft enclosure 11 can include adjustable panel legs 30, which can be varied in height, and wherein the adjustable panel legs 30 can be selectively extended or retraced such that an overall height and orientation of the enclosure can be adjusted to surfaces having variable heights. Adjustable panel legs can be cemented or otherwise affixed to the surface to further secure anti-theft enclosure 11 around A/C unit 10. For example, the legs could be provided with feet portions which have openings (such as opening 32 in FIG. 1) for receiving an anchor bolt or screw.

The open framework of structural members is itself comprised of a plurality of individual steel panels, such as panels 13, 15, 17, and 19. Each of the steel panels 13, 15, 17, and 19, is preferably constructed of polygonal lengths of metal tubing, such as the lengths of square steel tubing shown in the drawings. The lengths of square steel tubing which make up the steel panels are spaced a selected distance apart which allows ventilation and access to the quasi-enclosed area by a worker needing to access the A/C unit 10. The panels can be covered with a steel grating, or other covering material, which further restricts access to the A/C unit 10. The steel grating can completely or partially cover each of the panels.

Figure 2:
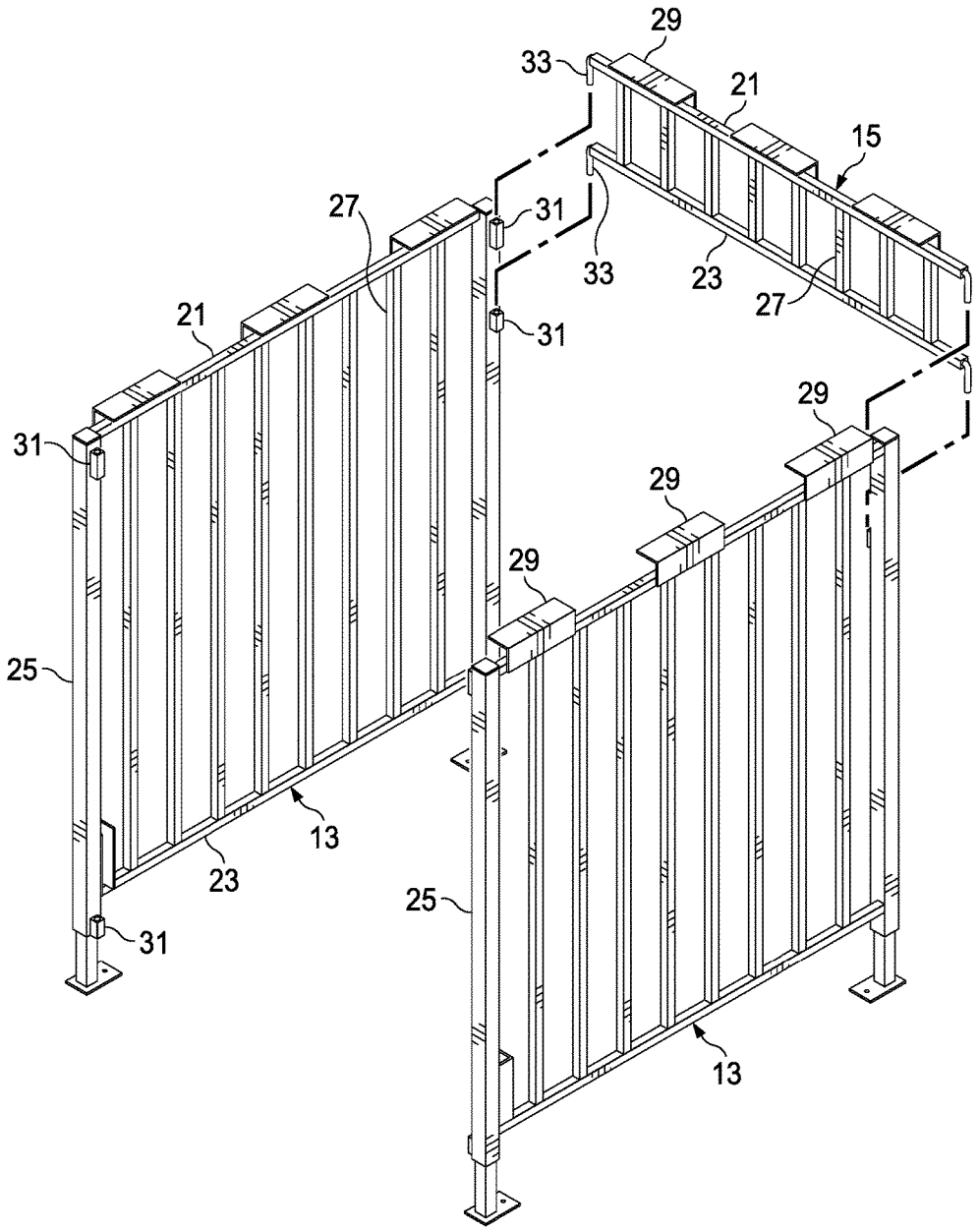
FIG. 2 is a partially exploded, perspective view of the anti-theft air conditioning enclosure, without a top panel or a front panel, and showing the rear panel, with its connecting elements, detached from the side panels, the side panels having mating elements and adjustable panel legs.

FIG. 2 shows the air conditioner enclosure of the invention in the unassembled state. Each side panel 13 includes a top rail 21, a bottom rail 23, a pair of oppositely arranged end posts 25, and a plurality of security bars 27. Side panel 13 end posts 25 are interconnected by the top rail 21 and the bottom rail 23. The plurality of security bars 27 run vertically between the top rail 21 and the bottom rail 23 of each side panel 13. The pair of opposing side panels 13 are provided with at least one retention flange 29 located at least partially along the respective top rails 21 of the opposing side panels 13. Each side panel 13 includes at least one mating element 31 on each of its two end posts 25. Mating element 31 has a receiving pocket for connecting rear panel 15 to the side panels 13.

Rear panel 15 includes a top rail 21, a bottom rail 23, and a plurality of security bars 27. The plurality of security bars 27 run vertically between the top rail 21 and the bottom rail 23 of rear panel 15. Rear panel 15 is provided with at least one retention flange 29 located at least partially along its top rail 21. Rear panel 15 includes connecting elements 33 at either of two opposite extents thereof, which are engageable with mating elements 31 of each side panel 13. Connecting element 33 has a connecting tab for connecting rear panel 15 to the side panels 13. The height of rear panel 15 is shorter than the height of side panels 13 so that pipes and other transmission lines can be connected to the building to provide temperature control thereto, without needing to run the lines in between the security bars 27 of the rear panel 15. The retention flanges 29 on each of the opposing side panels 13 and rear panel 15 cooperate to define an at least partially-enclosed track region which runs along each of the respective top rails 21 of the opposing side panels 13 and rear panel 15.

In operation, the individual steel panels which make up the perimeter of the anti-theft enclosure 11 are joined together using a plurality of connecting elements 33 and mating elements 31. To assemble the rear panel 15 and the opposing side panels 13 to form three of the walls of the anti-theft enclosure 11, the connecting elements 33 of rear panel 15 slide into the mating elements 31 of side panels 13, to securely connect rear panel 15 to side panels 13. Because the connecting elements 33 slide into the mating elements 31 from the top, rear panel 15 is supported in-place by the connection made between connecting elements 33 and mating elements 31. Accordingly, rear panel 15 can only be removed from side panels 13 by lifting the connecting elements 33 out of the mating elements 31 of side panels 13 and the three panels are prevented from removal by lateral forces.

Figure 3:
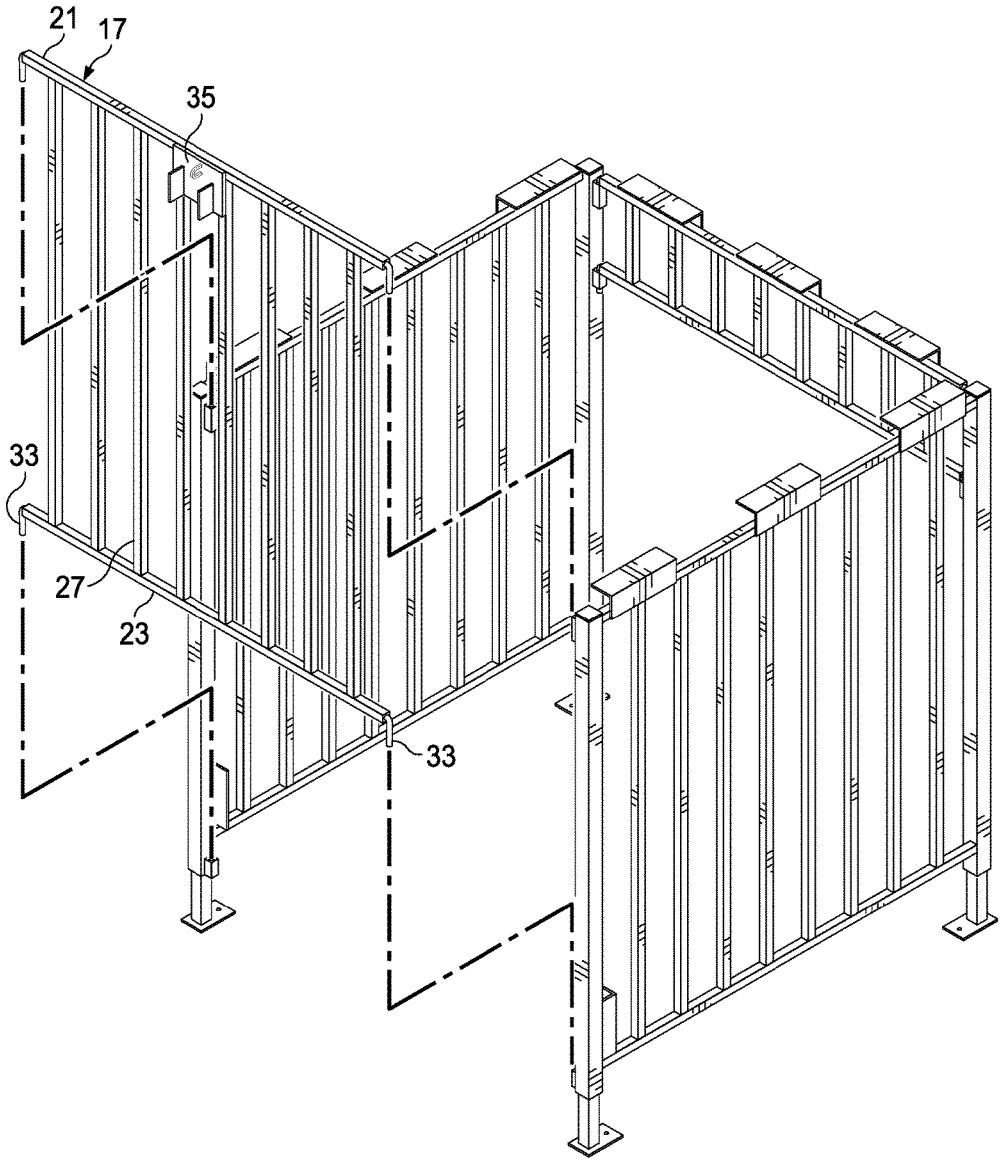
FIG. 3 is a partially exploded, perspective view of the anti-theft air conditioning enclosure, without a top panel and showing the front panel, with its connecting elements, the front panel being detached from the side panels, and their mating elements.

Referring now to FIG. 3, front panel 13 includes a top rail 21, a bottom rail 23, and a plurality of security bars 27. The plurality of security bars 27 run vertically between the top rail 21 and the bottom rail 23 of front panel 17. Front panel 17 includes oppositely arranged connecting elements 33, which are engageable with mating elements 31 on each of opposing side panels 13 for connecting front panel 17 to side panels 13, thereby defining an initially open top region of anti-theft enclosure 11. Connecting element 33 has a connecting tab for connecting front panel 17 to side panels 13.

To assemble the front panel 17 and the opposing side panels 13 to form the perimeter walls of the anti-theft enclosure 11, the connecting elements 33 of front panel 17 slide into the mating elements 31 of side panels 13, to securely connect front panel 17 to side panels 13. Again, because the connecting elements 33 slide into the mating elements 31 from the top, front panel 17 is supported in-place by the connection made between connecting elements 33 and mating elements 31.

Therefore, front panel 17 can only be removed from side panels 13 by lifting the connecting elements 33 out of the mating elements 31 of side panels 13 and the three panels are prevented from removal by lateral forces.

Figure 4:
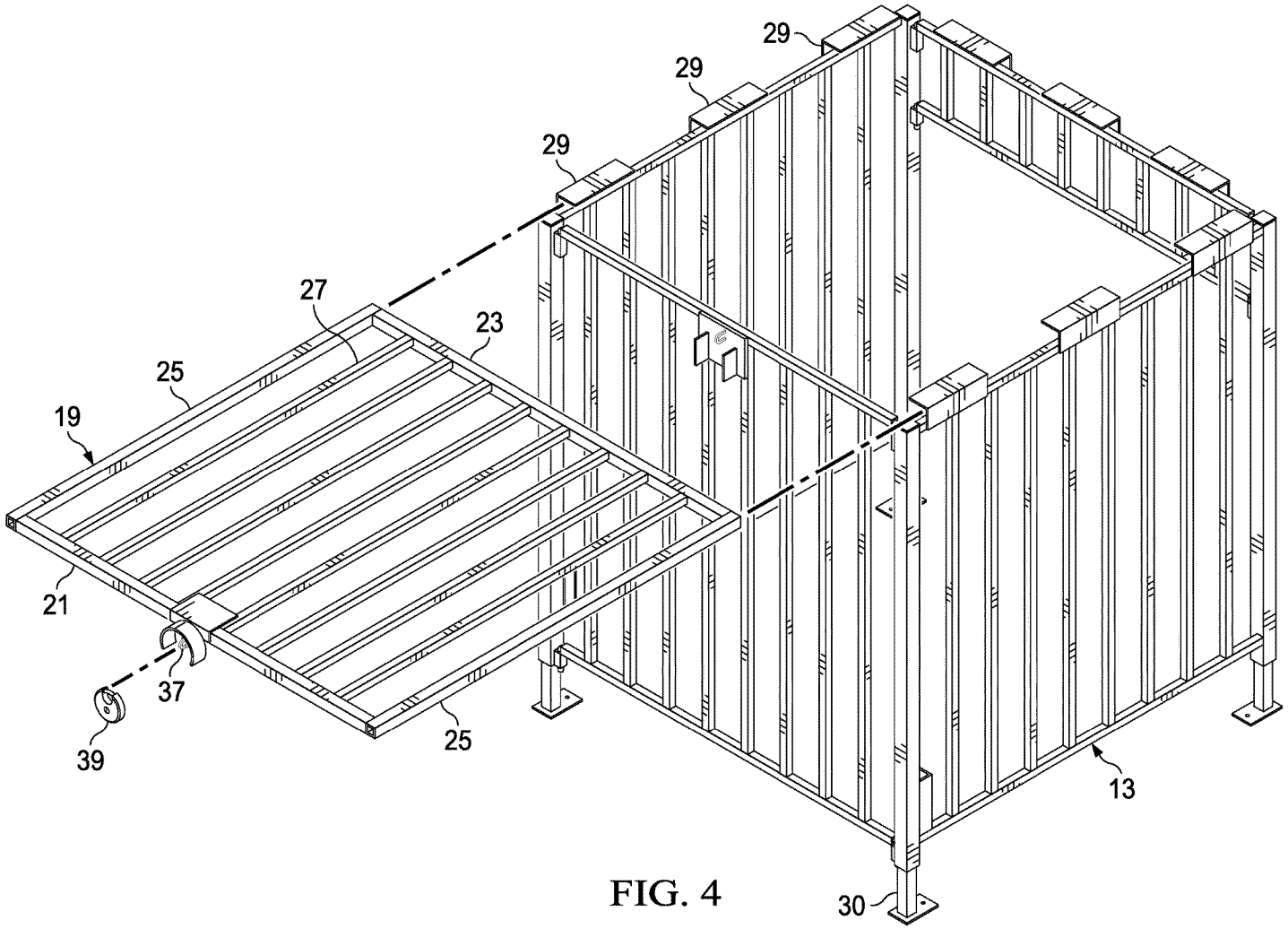
FIG. 4 is a partially exploded, perspective view of the anti-theft air conditioning enclosure, showing the initial step in installing the top panel onto the remainder of the enclosure, and also showing the locking components of the assembly including a padlock which is shown detached from the remainder of the assembly.

Referring now to FIG. 4, top panel 19 includes a top rail 21, a bottom rail 23, a pair of oppositely arranged end posts 25, and a plurality of security bars 27. Top panel 19 end posts 25 are interconnected by the top rail 21 and the bottom rail 23. The plurality of security bars 27 run vertically between the top rail 21 and the bottom rail 23 of top panel 19.

As best seen in FIG. 4, by orienting top panel 19 in a horizontal plane with respect to the generally vertical opposing side panels 13 and sliding top panel 19 within the enclosed track regions of opposing side panels 13 to thereby cover the initially open top region of anti-theft enclosure 11. Top panel 19 can be slid bottom-rail-end first into the track region, such that the top rail 21, bottom rail 23, and end posts 25 of top panel 19 rest on the top rails 21 of panels 13, 15, and 17, thereby securing the panels 13, 15, and 17, into position. Since top panel 19 is slid into position such that the retention flanges 29 overhang the front panel on three sides, such that top panel 19 cannot be removed by lifting or sliding it past rear panel 15, but only by sliding top panel 19 back out of the track region in the direction of the front panel. As discussed above, the perimeter panels can only be disassembled from each other by lifting the connecting elements 33 out of the mating elements 31. Accordingly, once the top panel is secured in place by padlock 39, which prevents the top panel from sliding out of the track region, anti-theft enclosure 11 is secure from disassembly by vertical or lateral threes.

Referring to FIGS. 3 and 4, one of either front panel 17 or top panel 19 of anti-theft enclosure 11 is provided with a lock plate 35 and the other of the respective front and top panels is provided with a mating lock ring 37, a selected one of the lock ring 37 and lock plate 35 being provided with a lock hasp, whereby a padlock 39 can be engaged with the lock hasp when the lock plate 35 and lock ring 37 are positioned adjacent one another to secure the top panel to the front panel and thereby form a secured enclosure. Alternatively, a lock collar can at least partially surround padlock 39 to provide additional security against bolt cutters.

Alternatively, anti-theft enclosure 11 can be customized to meet varying requirements by varying panel height and number. Any perimeter panel of anti-theft enclosure 11 can be a partial height panel formed by a top rail 21 and a bottom rail 23, which are interconnected by a plurality of security bars 27, security bars 27 can be of a lesser relative height than security bars 27 present in the other panels. Additionally, further side panels can be utilized to form anti-theft enclosure 11 with more than four sides. Additional panels can be added with the proper combination of connecting elements 33 and mating elements 31 to facilitate a secure connection between all perimeter panels. Depending on the number of panels utilized, some panels may need to have connecting elements 33 on one side and mating elements 31 on the other side of the same panel, as opposed to one panel having all connecting elements 33 or all mating elements 31 on both its sides.

An invention has been provided with several advantages. The anti-theft enclosure of the invention is relatively simple in design and economical to manufacture. It can be manufactured from readily available materials of the type commonly found in manufacturing operations. The enclosure is extremely sturdy and can withstand impacts of various kinds to protect the enclosed A/C unit. The open nature of the assembly continues to allow workers to access the A/C unit for routine tasks or repairs. Because the enclosure is made up of a series of interlocked panels, it can be easily and completely disassembled and moved to another well site with a minimum of effort. Advantageously, the panels of the present invention can be stacked one-on-top-of-the-other to facilitate ease of shipment and storage and requiring minimal packing material and storage space to maintain inventory. At times it may be necessary to completely remove any enclosure to allow for A/C unit replacement or replacement of larger components. The present invention provides an optimized solution for such situations by providing for quick, complete removal.

While the invention has been shown in one of its forms, it is not thus limited and is susceptible to various changes and modifications without departing from the spirit thereof.

I claim:

1. An anti-theft enclosure for encompassing an outdoor air conditioning unit, the anti-theft enclosure comprising:

a pair of opposing side panels spaced apart a selected distance and positionable generally perpendicular to a surface, each side panel having a pair of integral oppositely arranged end posts which are interconnected by a top and bottom rail, respectively, each panel also having a plurality of spaced apart security bars which run vertically between the top and bottom rails;

a rear panel connecting and supporting the pair of opposing side panels, the rear panel having integral connecting elements at either of two opposite extents thereof which are engageable with mating elements of each side panel and wherein there are two pairs of connecting elements each having downwardly extending connecting tabs which are received within mating tab receiving pockets provided on each of the opposing side panels for connecting the rear panel to the side panels, at least one pair of the tab receiving pockets being located on a selected oppositely arranged end post below the level of the respective top rail, whereby the rear panel can only be removed from the opposing side panels by lifting the connecting elements out of the mating elements of the side panels and the three panels are prevented from removal by lateral forces;

a front panel also having a top and bottom rail and interconnecting vertical security bars there between, the front panel having oppositely arranged downwardly extending connecting tabs which are also received within mating tab receiving pockets on each of the opposing side panels for connecting the front panel to the side panels, thereby defining an initially open top region of the enclosure, the front panel only being removable from the side panels by lifting the connecting tabs from the mating tab receiving pockets so that the three panels are prevented from removal by lateral forces;

wherein the pair of opposing side panels are each provided with a plurality of retention flanges which are located at spaced intervals along the respective top rails of the opposing side panels, the retention flanges cooperating to define a partially enclosed track region which runs along each of the respective top rails of the opposing side panels; and a top panel which, when oriented horizontally, is receivable within the track regions of the opposing side panels in sliding fashion to thereby cover the initially open top region of the enclosure and also cover at least selected ones of the engaged connecting elements and mating elements to prevent the front and rear panels from being lifted upwardly when the top panel is in place.

2. The anti-theft enclosure of claim 1, wherein the top panel is also made up of a top and bottom rail which are interconnected by a plurality of spaced apart security bars.

3. The anti-theft enclosure of claim 1, wherein the opposing side panels are also provided with adjustable panel legs which can be varied in height, such that an overall height of the enclosure can be varied to suit varying surfaces.

4. The anti-theft enclosure of claim 1, wherein the security bars which make up the side, front and top panels are constructed of lengths of polygonally shaped metal tubing.

5. The anti-theft enclosure of claim 1, wherein the security bars are made up of lengths of square steel tubing.

6. The anti-theft enclosure of claim 1, wherein one of the front and top panels of the enclosure is provided with a lock plate and the other of the respective front and top panels is provided with a mating lock ring, a selected one of the lock ring and lock plate being provided with a lock hasp, whereby a padlock can be engaged with the lock hasp when the lock plate and lock ring are positioned adjacent one another to secure the top panel to the front panel and thereby form a secured enclosure.

7. The anti-theft enclosure of claim 1, wherein the rear panel of the enclosure is a partial height panel formed by a top rail and a bottom rail which are interconnected by a plurality of security bars, the security bars being of lesser relative height than the security bars present in the opposing side panels and the front panel.

8. An anti-theft enclosure for encompassing an outdoor air conditioning unit, the anti-theft enclosure comprising:

a pair of opposing side panels spaced apart a selected distance and positionable generally perpendicular to a surface, each side panel having a pair of integral oppositely arranged end posts which are interconnected by a top and bottom rail, respectively, each panel also having a plurality of spaced apart security bars which run vertically between the top and bottom rails;

a rear panel connecting and supporting the pair of opposing side panels, the rear panel having integral connecting elements at either of two opposite extents thereof which are engageable with mating elements of each side panel and wherein there are two pairs of connecting elements each having downwardly extending connecting tabs which are received within mating tab receiving pockets provided on each of the opposing side panels for connecting the rear panel to the side panels, at least one pair of the tab receiving pockets being located on a selected oppositely arranged end post below the level of the respective top rail, whereby the rear panel can only be removed from the opposing side panels by lifting the connecting elements out of the mating elements of the side panels and the three panels are prevented from removal by lateral forces;

a front panel also having a top and bottom rail and interconnecting vertical security bars there between, the front panel having oppositely arranged downwardly extending connecting tabs which are also received within mating tab receiving pockets on each of the opposing side panels for connecting the front panel to the side panels, thereby defining an initially open top region of the enclosure, the front panel only being removable from the side panels by lifting the connecting tabs from the mating tab receiving pockets so that the three panels are prevented from removal by lateral forces;

wherein the pair of opposing side panels are each provided with a plurality of retention flanges which are located at spaced intervals along the respective top rails of the opposing side panels, the retention flanges cooperating to define a partially enclosed track region which runs along each of the respective top rails of the opposing side panels;

a top panel which, when oriented horizontally, is receivable within the track regions of the opposing side panels in sliding fashion to thereby cover the initially open top region of the enclosure and also cover at least selected ones of the engaged connecting elements and mating elements to prevent the front and rear panels from being lifted upwardly when the top panel is in place;

wherein one of the front and top panels of the enclosure is provided with a lock plate and the other of the respective front and top panels is provided with a mating lock ring, a selected one of the lock ring and lock plate being provided with a lock hasp, whereby a padlock can be engaged with the lock hasp when the lock plate and lock ring are positioned adjacent one another to secure the top panel to the front panel and thereby form a secured enclosure; and wherein the rear panel of the enclosure is a partial height panel formed by a top rail and a bottom rail which are interconnected by a plurality of security bars, the security bars being of lesser relative height than the security bars present in the opposing side panels and the front panel.

* * * * *